US010743605B2

(12) United States Patent
Cutler

(10) Patent No.: US 10,743,605 B2
(45) Date of Patent: Aug. 18, 2020

(54) SHOE ORTHOTIC DEVICE AND RELATED METHODS

(71) Applicant: Thomas Cutler, Visalia, CA (US)

(72) Inventor: Thomas Cutler, Visalia, CA (US)

( * ) Notice: Subject to any disclaimer, the term of this patent is extended or adjusted under 35 U.S.C. 154(b) by 26 days.

(21) Appl. No.: 16/132,146

(22) Filed: Sep. 14, 2018

(65) Prior Publication Data

US 2019/0069628 A1 Mar. 7, 2019

Related U.S. Application Data

(63) Continuation of application No. 16/124,158, filed on Sep. 6, 2018, now abandoned.

(60) Provisional application No. 62/554,579, filed on Sep. 6, 2017.

(51) Int. Cl.

| | |
|---|---|
| ***A43B 7/14*** | (2006.01) |
| ***A43B 17/02*** | (2006.01) |
| ***A43B 13/32*** | (2006.01) |
| ***A43B 17/14*** | (2006.01) |
| ***A43B 17/18*** | (2006.01) |

(52) U.S. Cl.

CPC ..... *A43B 7/142* (2013.01); *A43B 7/143* (2013.01); *A43B 7/1445* (2013.01); *A43B 7/1465* (2013.01); *A43B 13/32* (2013.01); *A43B 17/023* (2013.01); *A43B 17/14* (2013.01); *A43B 17/18* (2013.01)

(58) Field of Classification Search

CPC ..... A43B 7/142; A43B 7/143; A43B 7/1445; A43B 7/1465; A43B 17/023; A43B 17/14; A43B 17/18

See application file for complete search history.

(56) References Cited

U.S. PATENT DOCUMENTS 2,978,818 A * 4/1961 Baumann ..... A43B 7/22 36/145
4,235,028 A 11/1980 Riggs
4,694,590 A * 9/1987 Greenawalt ..... A43B 7/1415 36/163
4,969,224 A * 11/1990 Birke ..... A43B 9/00 12/142 F (Continued)

OTHER PUBLICATIONS

International Searching Authority—International Search Report and the Written Opinion, International application No. PCT/US 18/51221, dated Jan. 7, 2019.

*Primary Examiner* — Ted Kavanaugh
(74) *Attorney, Agent, or Firm* — William K. Nelson

(57) ABSTRACT

The present invention provides an improved orthotic device adapted to be inserted into a high-heeled or raised-heel shoe and to receive a human foot thereon. The orthotic device may be operable to adhere to the sole of the shoe and may comprise a proximal contoured slope operable to prevent migration and increase acceptance of body weight at the heel of the wearer's foot and may comprise a distal contoured slope operable to support the arch of the wearer's foot, preventing the foot from sliding forward and focusing excessive painful pressure at the user's toes. The orthotic device may also have dual layers of adhesive material separated by a peel-away backing, and an inferior surface concavity with a channel allowing solvent to be used to dissolve the adhesive if the orthotic device needs to be repositioned or changed to a new shoe.

24 Claims, 5 Drawing Sheets

(56) References Cited

U.S. PATENT DOCUMENTS

| | | | | |
|---|---|---|---|---|
| 5,373,650 | A | 12/1994 | Dananberg et al. | |
| 5,438,768 | A | 8/1995 | Bauerfeind | |
| 6,518,230 | B2 | 2/2003 | Wu et al. | |
| 6,990,756 | B1 | 1/2006 | Johnson | |
| 7,854,075 | B2 | 12/2010 | Kosmas | |
| 8,914,995 | B2 | 12/2014 | Andrews | |
| 2004/0211086 | A1 | 11/2004 | Dananberg | |
| 2006/0029764 | A1 | 9/2006 | Coppens et al. | |
| 2007/0107263 | A1* | 5/2007 | Lopez | A43B 7/144 36/71 |
| 2010/0180467 | A1* | 7/2010 | Singleton | A43B 7/141 36/88 |
| 2013/0180023 | A1 | 7/2013 | Gross et al. | |
| 2014/0338221 | A1 | 11/2014 | Pride | |
| 2016/0044990 | A1* | 2/2016 | Georgeson | A43B 23/28 36/43 |
| 2017/0055629 | A1 | 2/2017 | Schickling | |

* cited by examiner

SHOE ORTHOTIC DEVICE AND RELATED METHODS

FIELD OF THE INVENTION

The present invention relates to orthotic devices, and more specifically to orthotic devices for use in high-heeled shoes.

DISCUSSION OF THE BACKGROUND

"Orthotics" are used to correct foot discomfort and abnormalities. Many orthotic devices may be integrally formed in a shoe or adapted to be received by a shoe. Such orthotic devices commonly are used to correct abnormalities and/or to prevent foot problems or injury arising from the wearing of high-heeled dress shoes.

The cause of high heel discomfort is excessive pressure on the toes caused by an inability to sufficiently support body weight on the heel. This results in migration of the foot away from an optimal position in the shoe. For example, anterior translation of the foot relative to the insole in a high heel can result in the toes of the wearer being constrained by the structure of the shoe, creating discomfort. In other words, the foot slides forward, squeezing or smashing the toes. This situation may not only cause temporary discomfort and a desire to take the shoes off before the end of a work day or an evening event, but chronic use may lead to the development of bunions—a painful misshaping of the joints of the big toe—which can require corrective surgery. Resolution of the problem of foot migration in high-heeled shoes, without creating additional complications, is a long-standing and unmet need.

Prior art that attempts to provide a solution to problems with high heels typically involve removable foot orthoses that are of limited efficacy. Since the pain manifests at the ball of the foot (metatarsals) or at the toes, most orthotic devices specifically targeting high heel shoes are focused on cushioning the painful areas of the forefoot. One device known commercially as the "Foot Bumper" tries to address slipping at the toe sulcus (anatomical crease between the ball of the foot and the toes). Numerous pads (adherent and adhesive) are available which try to provide cushioning for the metatarsals. Other orthotic devices are designed to provide support for the arches of the foot or try to translate the arch support that is appropriate for a flat shoe into a steeply sloped environment. None of the prior art of this nature specifically targets preventing anterior migration of the heel, hindfoot, or the calcaneus (heel bone). They are designed to preserve, support, and/or restore the arches or structures of the foot. Other solutions include specially manufactured shoes. However, the wide variance in foot anatomy prevents such orthotic shoe designs from helping all sufferers of foot pain and injury. Also, specially manufactured shoes are not preferable, as fashion is fluid and many consumers would desire the ability to choose any high-heeled shoe which they may find while shopping, and improve the fit of that particular shoe rather than ordering from a limited selection of specially fitted shoes. Overall, currently there is no single shoe or removable device that will suffice as a satisfactory solution for the discomfort experienced with high heel shoes.

Thus, there is a persistent need for a more generally effective orthotic device for solving the issues presented by high-heeled shoes.

DESCRIPTION OF THE INVENTION

The present invention provides an improved orthotic device adapted to be incorporated into a high-heeled or raised-heel shoe and to receive a human foot thereon. The orthotic device may be operable to adhere or attach via adhesive to the insole of the shoe in a position which allows the device to prevent anterior migration of the heel of the wearer's foot, increasing the amount of user body weight supported by the heel, and thus preventing the foot from sliding forward and squishing the user's toes, causing pain. The orthotic device may have a shape which easily fits into a wide variety of different shoes and is effective with many differently shaped feet, and may be made from a material which is strong enough to provide migration resistance and increase heel weight-bearing while maintaining a cushioned feel.

The orthotic device may also have dual layers of adhesive material separated by a peel-away backing. A temporary outer adhesive layer on the outside of the peel-away backing allows a user to test the position of the device for comfort in the high-heeled shoe, prior to then removing the backing and setting the device in place with the long-term (setting) adhesive layer on the bottom surface of the device itself.

Finally, the orthotic device may have a channel leading from the upper surface to a concavity on the bottom surface, allowing a solvent to be injected into the concavity in order to help dissolve the setting adhesive layer if the placement of the device needs to be adjusted or the device needs to be transferred to a new shoe.

The present invention may provide an orthotic device having proximal and distal contoured slopes, and a plurality of adhesive layers for fitting and setting the device to the sole of a shoe.

In some embodiments, the orthotic device is an adhesive attachment for insertion into a high-heeled or raised-heel shoe that provides an anatomically contoured support for the calcaneus (heel) bone, preventing anterior migration of the foot. The orthotic device is operable to be positioned on the insole of a high-heeled or raised-heel shoe just anterior to the seat of the shoe (e.g., where the slope of the insole transitions to a steeper angle anterior to the heel), beneath the foot and the anterior areas of the calcaneus, and may comprise a shape that is complementary to the general shape of the heel. The orthotic device may extend anteriorly from beneath the calcaneus toward the distal end of the foot such that it terminates before reaching the metatarsals (under the arch) of the foot. The orthotic device may also comprise a downward sloping, concave shape from a point anterior to the calcaneus, providing undergirding support for the arch of the foot, thus combining anti-migration with support.

The orthotic device may comprise a body made from a rigid or semi-rigid material operable to substantially maintain its shape under the body weight of a human applied to the orthotic device via the foot. For example, the orthotic device may be made from a rigid or semi-rigid polymeric material, such as ethylene vinyl acetate, polyethylene closed cell foam material (e.g., PeLite) or foam material with equivalent characteristics. In some embodiments, the orthotic device may have multiple materials of different rigidity (as tested via durometer, e.g., materials having 35-40 durometer) to allow the device to both provide a support structure and some cushion at the upper surface thereof for the user's comfort.

In some embodiments, the orthotic device may comprise a generally triangular outer profile with rounded corners when viewed from above, with a concave proximal (heel) border and a blunted distal (arch) border. In some embodiments, the superior surface of the device may comprise a ridge forming a crescent shape which curves from the corners of the proximal end of the device in toward the center of the device. The ridge may thus define a divide between a proximal contoured slope and a distal contoured slope.

The proximal contoured slope may comprise a concavity or a flat slope and may be operable to sit under and anterior to the heel of the wearer to prevent slipping and counter act the tendency of the foot to slide forward or migrate in the high-heeled or raised heel shoe. The proximal contoured slope may be crescent-shaped to encapsulate and complement the anterior load-bearing morphology and contours of the calcaneus.

The distal contoured slope may comprise a substantially flat surface sloping down toward the blunted distal end of the device, the distal contoured slope having a shape which is complementary to the arch of the wearer's foot or intended to have no effect on the arch of the user's foot.

The device may further comprise a first lateral contoured slope and a second lateral contoured slope, the first and second lateral contoured slopes being located on either side of the proximal and distal contoured slopes, providing a non-obtrusive transition from the slopes of the device to the insole of the shoe. The first and second contoured slopes may each comprise a substantially flat surface having a steeper slope than that of the distal contoured slope. In other embodiments, the superior surface of the device may comprise a different shape which is complementary to the bottom of the wearer's foot.

In some embodiments, the device may further comprise one or more additional materials on the superior surface to aid in support and comfort of the wearer and preventing slippage of the foot. For example, the device may have a fabric top-cover to alter shear forces and may also have textiles that provide additional traction.

In some embodiments, the inferior surface of the device may comprise a flat surface coated with a setting adhesive. In some embodiments, the setting adhesive may comprise an adhesive substance (i.e., a glue, cement, mucilage, overlaying tape, or paste) capable of securing the device to the sole of a shoe. In some embodiments, the setting adhesive may secure the device to the sole of the shoe in a substantially permanent manner. In other embodiments, the setting adhesive may provide a semi-permanent attachment between the sole of the shoe and the inferior surface of the device. In such embodiments, the first adhesive substance may secure the device to the shoe during regular use by the wearer, but may be dissolved via an appropriate adhesive solvent (i.e., TOPSOL, BESTINE, or BEAN-e-doo, etc.), releasing the device from the shoe for the purpose of adjusting the fit of the device or removing the device from the shoe. The setting adhesive may comprise a commercially available textile adhesive or shoe adhesive (i.e., Shoe-Fix Glue, Shoo Goo, Aleene, etc.).

The setting adhesive on the inferior surface of the device may require preservation against drying out or oxidation from the air, and protection from physical contact with packaging and other objects (i.e., the fingers of the wearer) in the period between the manufacture of the device and the final setting of the device in a shoe. In some embodiments, the setting adhesive may be thus preserved and protected via a first peel-away backing. The first peel-away backing may comprise a thin layer of flexible material (i.e., a plastic) with a shape which covers the inferior surface of the device and provides a tab operable to be used to peel the first peel-away backing from the device. The first peel-away backing may comprise a low-adherence superior surface such that it may be easily peeled off of the setting adhesive while removing substantially none of the setting adhesive from the inferior surface of the device.

In some embodiments, the device may further comprise a fitting adhesive on the inferior side of the first peel-away backing, the fitting adhesive comprising an adhesive substance which provides a temporary, releasable adherence between the device and the sole of a shoe. The fitting adhesive may thus be utilized to test the position of the device within the shoe for comfort, and then release the device from the sole for repositioning and setting via the setting adhesive. The fitting adhesive may be applied to a portion of the inferior surface of the first peel-away backing and may be preserved and protected via a second (fitting) peel-away backing. The fitting peel-away backing may comprise a thin layer of flexible material (i.e., a plastic) with a shape which covers the portion of the inferior surface of the first peel-away backing which is covered with fitting adhesive, and may provide a tab operable to be used to peel the fitting peel-away backing from the first peel-away backing and the fitting adhesive. The fitting peel-away backing may comprise a low-adherence superior surface such that it may be easily peeled off of the fitting adhesive while removing substantially none of the fitting adhesive from the inferior surface of the first peel-away backing.

In some embodiments, the device may comprise an inferior surface concavity, the inferior surface concavity being located substantially centrally within the inferior surface of the device. The inferior surface concavity may comprise a substantially flattened hemispherical shape (i.e., circular concavity which is not as deep as it is wide). In such embodiments, the device may further comprise an adhesive solvent channel, the adhesive solvent channel comprising a passage linking the inferior surface concavity to the superior surface of the device. The adhesive solvent channel may thus provide access for an adhesive solvent to be transferred into the inferior surface concavity, allowing the setting adhesive to be dissolved if the wearer needs to change the placement of the device for comfort, or wants to transfer the device to a different shoe.

In other embodiments, the setting adhesive may comprise a releasable mechanical securing device such as a hook-and-loop structure (i.e., Velcro). In such embodiments, the inferior surface of the device may comprise one side of the securing device (i.e., the hooks) while the other side of the securing device (i.e., the looped fibers) are substantially permanently adhered to the sole of the shoe. In some embodiments, the settting adhesive may comprise a combination of the first adhesive substance and the releasable securing device.

In some implementations, the present invention may provide an orthotic device for insertion into a high-heeled or raised-heel shoe for a human foot, comprising: a rigid or semi-rigid body having: a proximal contoured slope having a shape that is complementary to a shape of the heel of the foot, a distal contoured slope operable to be positioned below a portion of an arch of the foot, and an inferior surface for interfacing with a sole of a shoe; and a setting adhesive for attaching the orthotic device to the sole. In some implementations, the device comprises a substantially flat inferior surface, the inferior surface being coated with the setting adhesive. In some implementations, the device further comprises a first peel-away backing for protecting and preserving the setting adhesive. In some implementations, the first peel-away backing comprises a low-adherence superior surface and a tab, such that the first peel-away backing may be easily peeled from the inferior surface of the device. In some implementations, the first peel-away backing comprises an inferior surface coated with a fitting adhesive. In some implementations, the device further comprises a fitting peel-away backing for protecting and preserving the fitting adhesive. In some implementations, the fitting peel-away backing comprises a low-adherence superior surface and a tab, such that the fitting peel-away backing may be easily peeled from the inferior surface of the setting peel-away backing. In some implementations, the fitting adhesive is operable to provide a temporary, releasable adherence between the device and the sole of the shoe. In some implementations, the setting adhesive is operable to provide a permanent attachment between the inferior surface of the device and the sole of the shoe. In some implementations, the device further comprises an inferior surface concavity and an adhesive solvent channel, the adhesive solvent channel providing a passage from a superior surface of the device to the inferior surface concavity. In some implementations, the setting adhesive is operable to provide a semi-permanent attachment between the inferior surface of the device and the sole of the shoe. In some implementations, the setting adhesive may be dissolved by an appropriate adhesive solvent, the adhesive solvent being injected into the inferior surface concavity via the adhesive solvent channel. In some implementations, the setting adhesive comprises a securing device. In some implementations, the securing device comprises a hook-and-loop device. In some implementations, the rigid or semi-rigid body comprises at least two materials, the at least two materials including a rigid or semi-rigid material for providing structure and maintaining a shape of the orthotic device and a relatively soft material on a superior surface of the orthotic device to provide comfort for the human foot. In some implementations, the device further comprises a fabric for preventing slippage and shearing forces on the superior surface of the orthotic device.

In some implementations, the present invention provides a method of using the orthotic device described above, comprising the steps of: peeling away the first peel-away backing; inserting the orthotic device into the high-heeled or raised-heel shoe in a position anterior to the heel such that the heel rests on the proximal contoured slope when a wearer fully inserts the foot into the high-heeled or raised-heel shoe; and securing the orthotic device to the sole of the shoe with the fitting adhesive. In some implementations, the method of using the orthotic device further comprises the steps of: peeling away the fitting peel-away backing; securing the orthotic device to the sole of the shoe with the fitting adhesive; and determining whether the position of the device in the shoe requires adjustment, and if so, adjusting the position of the device.

In some implementations, the present invention provides a method of using the device described above, comprising the steps of: inserting the orthotic device into the high-heeled or raised-heel shoe in a position anterior to the heel such that the heel rests on the proximal contoured slope when a wearer fully inserts the foot into the high-heeled or raised-heel shoe; securing the orthotic device to the sole of the shoe with the fitting adhesive; directing the adhesive solvent into the inferior surface concavity via the adhesive solvent channel; and removing the orthotic device from the sole of the shoe. In some implementations, the method further comprises the step of replacing the orthotic device either in a different position on the sole of the shoe, or on a second sole of a second shoe Further objects and aspects of the present invention will be apparent from the description provided herein.

DETAILED DESCRIPTION OF THE DRAWINGS

Figure 1B:
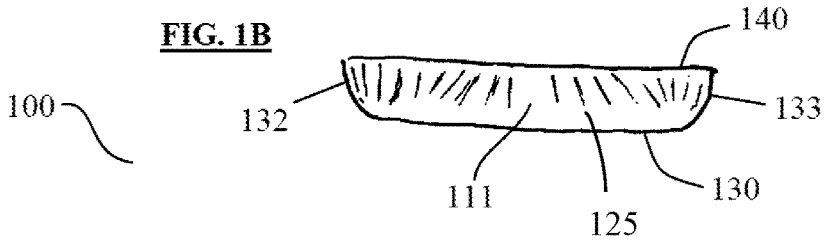
FIG. 1B shows a rear side view of an orthotic device, according to an embodiment of the present invention.
Figure 1D:
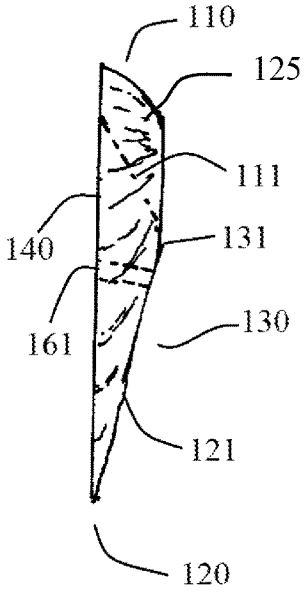
FIG. 1D shows a side view of an orthotic device, according to an embodiment of the present invention.
Figure 1A:
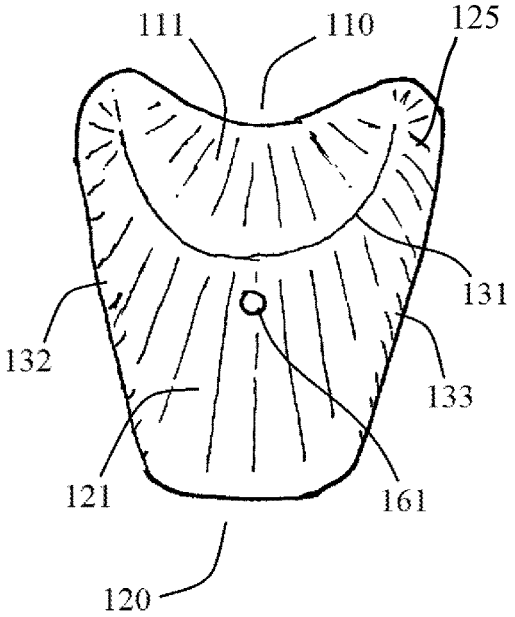
FIG. 1A shows a top-down view of an orthotic device, according to an embodiment of the present invention.
Figure 1E:
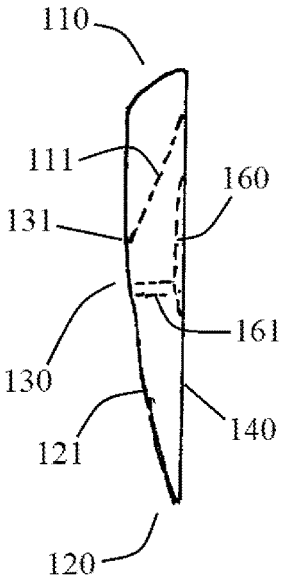
FIG. 1E shows a cut-away side view of an orthotic device, according to an embodiment of the present invention.
Figure 1C:
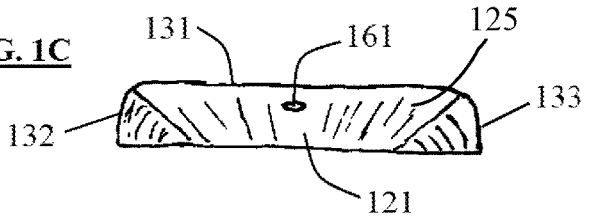
FIG. 1C shows a front side view of an orthotic device, according to an embodiment of the present invention.

Reference will now be made in detail to certain embodiments of the invention, examples of which are illustrated in the accompanying drawings. While the invention will be described in reference to these figures and certain implementations and examples of the embodiments, it will be understood that such implementations and examples are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. References to various features of the "present invention" throughout this document do not mean that all claimed embodiments or methods must include the referenced features. It will be apparent to one skilled in the art that the present invention may be practiced without these specific details or features.

Reference will be made to the exemplary illustrations in the accompanying drawings, and like reference characters may be used to designate like or corresponding parts throughout the several views of the drawings.

Figure 2:
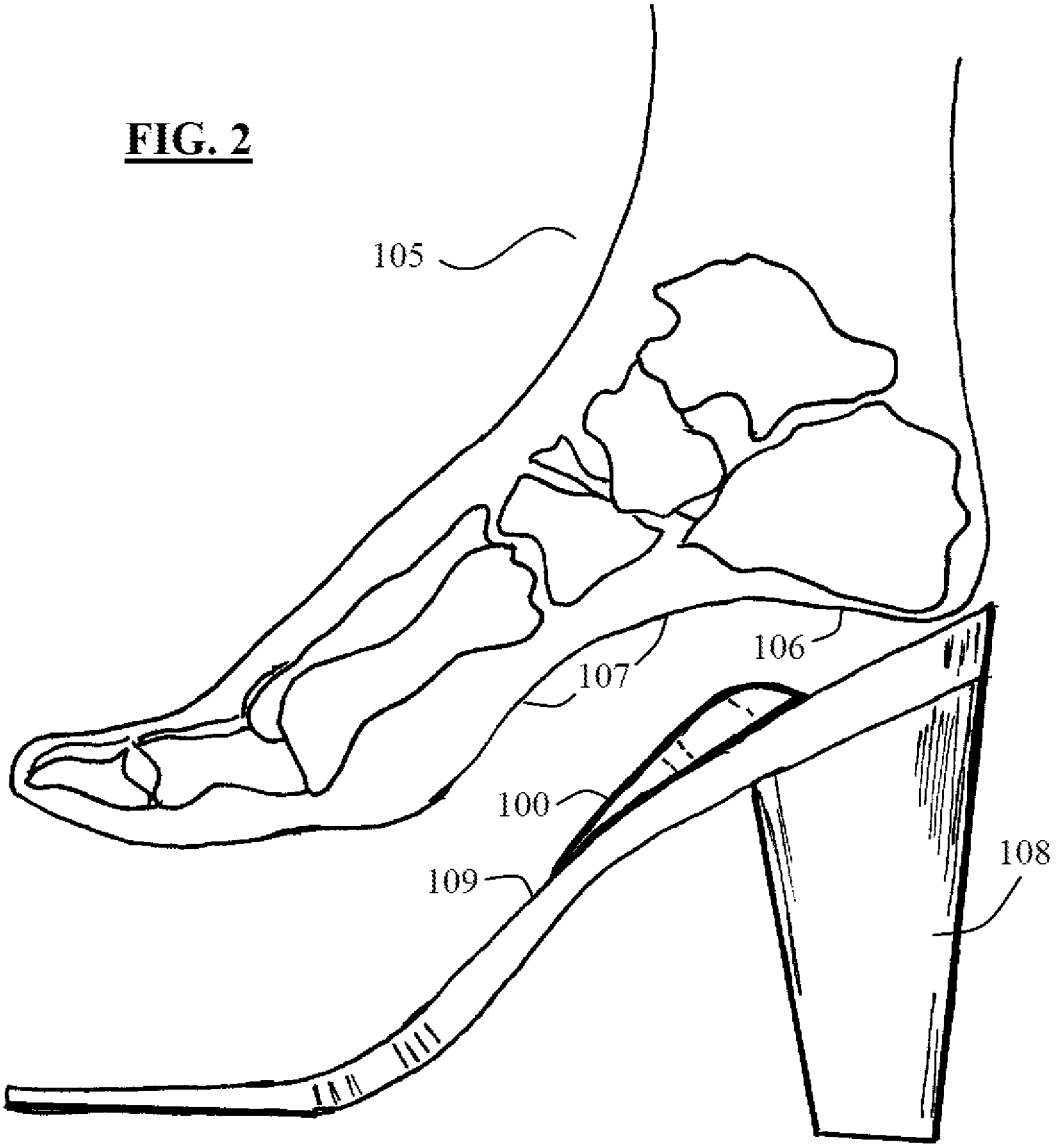
FIG. 2 shows a side view of an orthotic device in use, according to an embodiment of the present invention.

The present invention relates to orthotic device 100 having proximal 111 and distal 121 contoured slopes, and a plurality of adhesive layers 141, 151 for fitting and setting the device 100 to the sole 109 of a wearer's shoe 108 (see FIG. 2).

As seen in FIGS. 1A-1E, the orthotic device 100 may comprise a generally triangular outer profile with rounded corners when viewed from above, with a concave proximal (heel) 110 end and a blunted distal (arch) end 120. The superior surface 130 of the device may comprise a ridge 131 forming a crescent shape which curves from the corners of the proximal end 110 of the device 100 in toward the center of the device 100. The ridge 131 may thus define a divide between a proximal contoured slope 111 and a distal contoured slope 121. The device further comprises a fabric 125 for preventing slippage and shearing forces on the superior surface of the orthotic device.

The proximal contoured slope 111 may comprise a concavity 112 and may be operable to sit under and anterior to the heel 106 of the wearer 105 to provide support and counter act the tendency of the foot to slide forward in the high-heeled or raised heel shoe 108. The proximal contoured slope 111 may be crescent-shaped to encapsulate the anterior load-bearing morphology and contours of the heel 106.

The distal contoured slope 121 may comprise a substantially flat surface 122 sloping down toward the blunted distal end 120 of the device 100, the distal contoured slope 121 having a shape which is complementary to the arch 107 of the wearer's foot.

The device 100 may further comprise a first lateral contoured slope 132 and a second lateral contoured slope 133, the first and second lateral contoured slopes 132, 133 being located on either side of the distal contoured slope 121, running from an edge of the distal contoured slope 121 down to the sole 109 of the shoe 108. The first and second contoured slopes 132, 133 may each comprise a substantially flat surface having a steeper slope than that of the distal contoured slope 121.

Figure 3A:
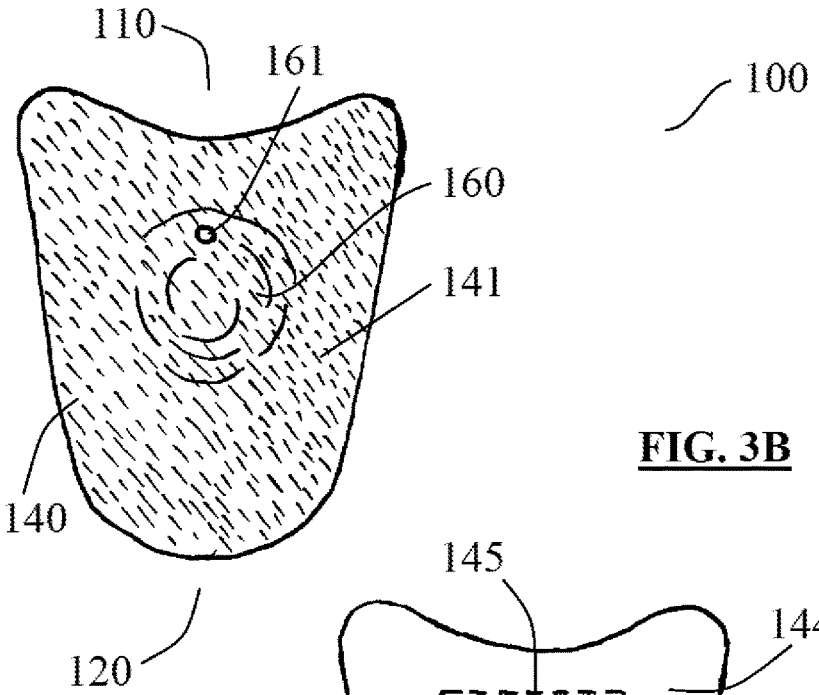
FIGS. 3A-3C each show a bottom-up view of an orthotic device, according to an embodiment of the present invention.
Figure 3B:
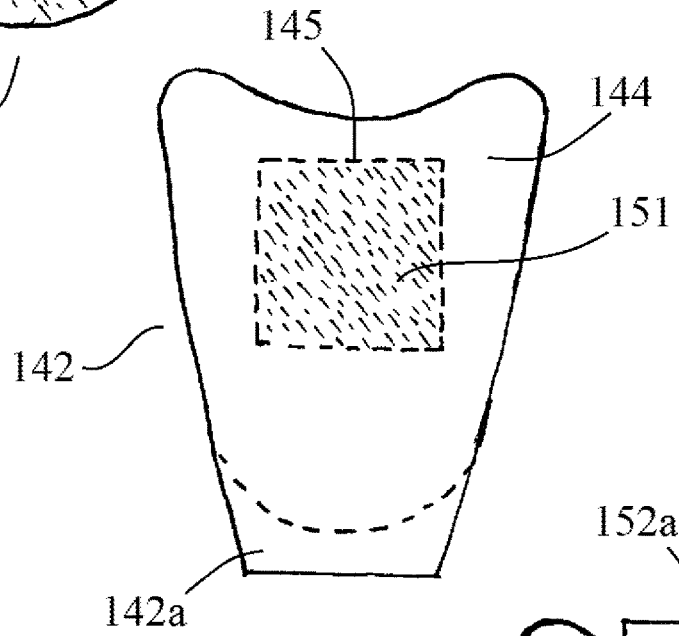
Figure 3C:
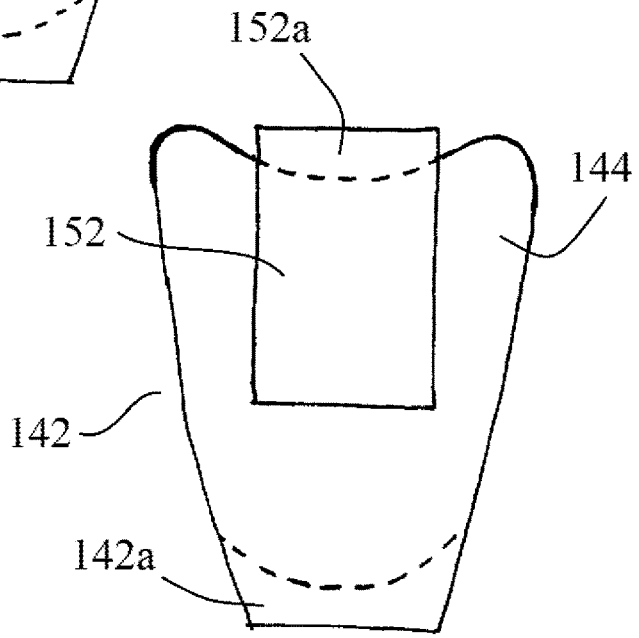

As seen in FIGS. 3A-3C, the inferior surface 140 of the device 100 may comprise a substantially flat surface coated with a first setting adhesive 141. The setting adhesive 141 may comprise an adhesive substance (i.e., a glue, cement, mucilage, or paste) capable of securing the device 100 to the sole 109 of a shoe 108 in a semi-permanent manner, wherein the setting adhesive 141 may secure the device 100 to the shoe unless dissolved via an appropriate adhesive solvent, releasing the device 100 from the shoe 108.

Figure 4:
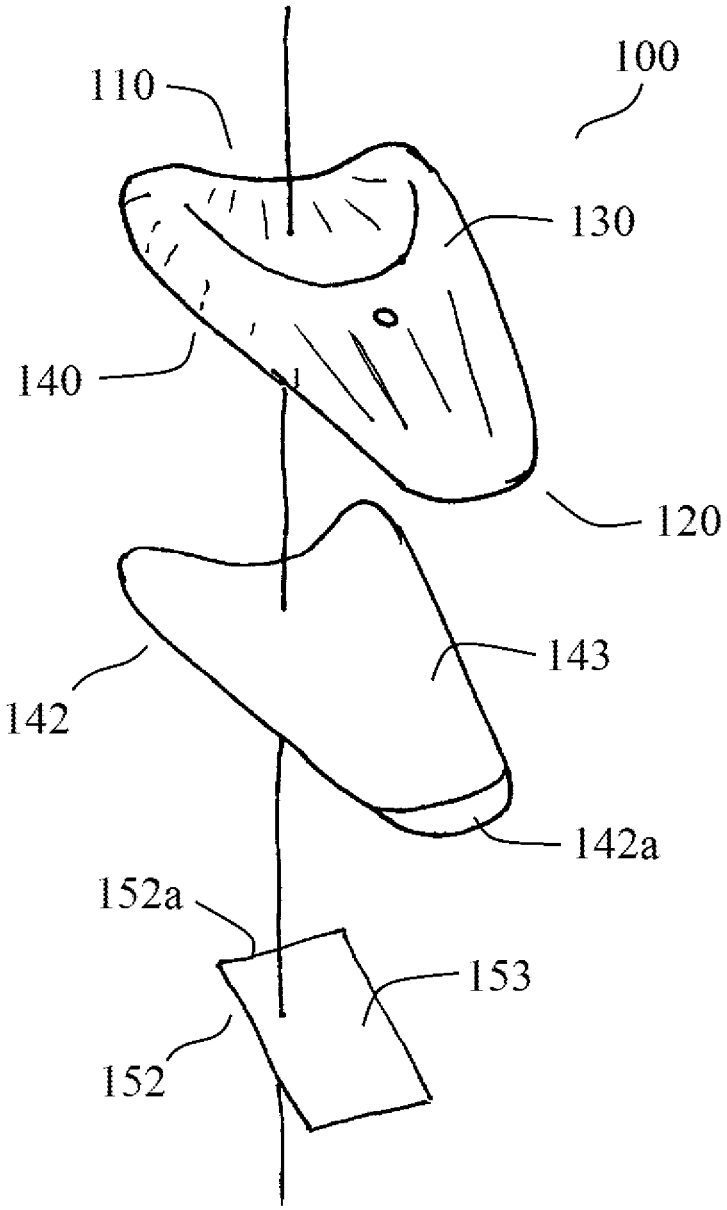
FIG. 4 shows a perspective view of an orthotic device, according to an embodiment of the present invention.
Figure 5:
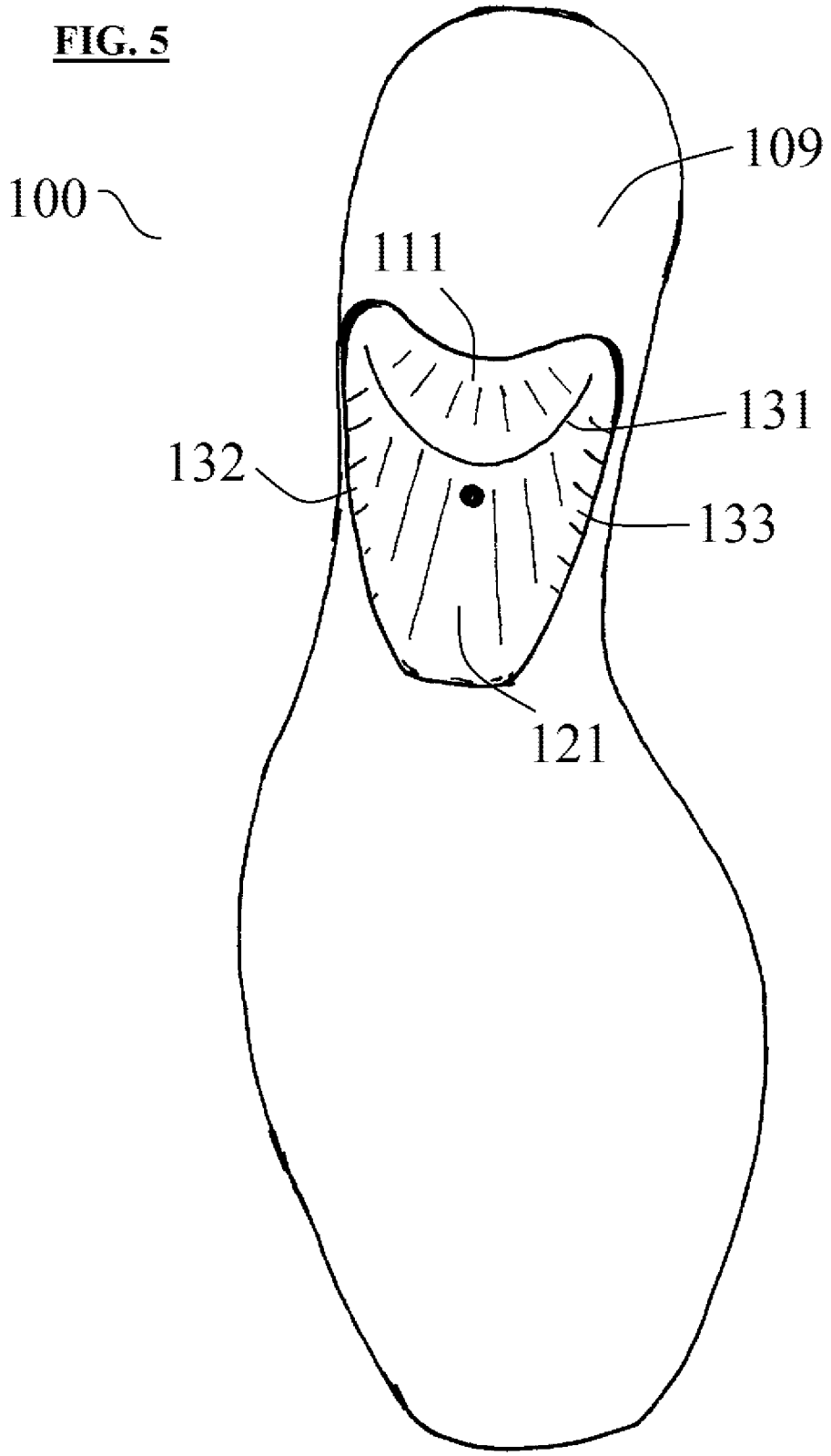
FIG. 5 shows a top-down view of an orthotic device secured on the sole of a shoe, according to an embodiment of the present invention.

The setting adhesive 141 on the inferior surface 140 of the device 100 may require preservation against drying out or oxidation from the air, and protection from physical contact with packaging and other objects (i.e., the fingers of the wearer) in the period between the manufacture of the device and the final setting of the device in a shoe 108. The setting adhesive 141 may be thus preserved and protected via a first peel-away backing 142. The first peel-away backing 142 may comprise a thin layer of flexible material (i.e., a plastic) with a shape which covers the inferior surface 140 of the device 100 and provides a tab 142*a* operable to be used to peel the first peel-away backing 142 from the device 100. The first peel-away backing 142 may comprise a low-adherence superior surface 143 (see FIG. 4) such that it may be easily peeled off of the first adhesive 141 while removing substantially none of the setting adhesive 141 from the inferior surface 140 of the device 100.

The device 100 may further comprise a second, fitting adhesive 151 on the inferior surface 144 of the first peel-away backing 142, the fitting adhesive 151 comprising an adhesive substance which provides a temporary, releasable adherence between the device 100 and the sole 109 of a shoe 108. The fitting adhesive 151 may thus be utilized to test the position of the device 100 within the shoe 108 for comfort, and then release the device 100 from the sole 108 for repositioning and long-term setting via the setting adhesive 141. The fitting adhesive 151 may be applied to a portion 145 of the inferior surface 144 of the first peel-away backing 142 and may be preserved and protected via a fitting peel-away backing 152. The fitting peel-away backing 152 may comprise a thin layer of flexible material (i.e., a plastic) with a shape which covers the portion 145 of the inferior surface 144 of the first peel-away backing 142 which is covered with fitting adhesive 151, and may provide a tab 152*a* operable to be used to peel the fitting peel-away backing 152 from the first peel-away backing 142. The fitting peel-away backing 152 may comprise a low-adherence superior surface 153 such that it may be easily peeled off of the fitting adhesive 151 while removing substantially none of the fitting adhesive 151 from the inferior surface 144 of the first peel-away backing 142.

The device may comprise an inferior surface concavity 160, the inferior surface concavity being located substantially centrally within the inferior surface 140 of the device 100. The inferior surface concavity 160 may comprise a substantially flattened hemispherical shape (i.e., circular concavity which is not as deep as it is wide). The device may further comprise an adhesive solvent channel 161, the adhesive solvent channel 161 comprising a passage linking the inferior surface concavity 160 to the superior surface 130 of the device 100. The adhesive solvent channel 161 may thus provide access for an adhesive solvent to be transferred into the inferior surface concavity 160, allowing the setting adhesive 141 to be dissolved if the wearer needs to change the placement of the device 100 for comfort, or wants to transfer the device 100 (e.g., to change the placement thereof for comfort).

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed:

1. An orthotic device for insertion into a shoe for a human foot, comprising:

a. a rigid or semi-rigid body having:

i. a proximal contoured slope having a shape that is complementary to a shape of a portion of a heel of said foot, ii. a distal contoured slope operable to be positioned below a portion of an arch of said foot, and iii. an inferior surface for interfacing with a insole of a shoe;

b. a fitting adhesive operable to temporarily attach the body to the insole of shoe to test at least one location on the insole of the shoe for fit with said foot, said fitting adhesive being attached to a peel-away backing allowing the fitting adhesive to be removed from the body; and c. a setting adhesive for attaching said orthotic device to said insole to prevent migration of the foot when said shoe is worn thereon.

2. The device of claim 1, wherein said inferior surface has a substantially flat portion, said inferior surface being coated with said setting adhesive.

3. The device of claim 2, wherein said peel-away backing also protects and preserves said setting adhesive.

4. The device of claim 3, wherein said peel-away backing comprises a low-adherence superior surface and a tab, such that said peel-away backing may be easily peeled from said inferior surface of said device.

5. The device of claim 3, wherein said first peel-away backing comprises an inferior surface, wherein said peel-away backing is in contact with said setting adhesive on a first side thereof and a second side thereof is coated with said test adhesive.

6. The device of claim 5, further comprising a second peel-away backing for protecting and preserving said fitting adhesive.

7. The device of claim 6, wherein said second peel-away backing comprises a low-adherence superior surface and a tab, such that said second peel-away backing may be easily peeled from said fitting adhesive and said inferior surface of said first peel-away backing.

8. The device of claim 1, further comprising an inferior surface concavity and an adhesive solvent channel, said adhesive solvent channel providing a passage from a superior surface of said device to said inferior surface concavity.

9. The device of claim 1, further comprising a fabric for preventing slippage and shearing forces on said superior surface of said orthotic device.

10. An orthotic device for insertion into a raised-heel shoe for a human foot, comprising:

a. a rigid or semi-rigid body having:
   i. a proximal contoured slope having a shape that is complementary to an anterior shape of a heel of said foot, and
   ii. an inferior surface for interfacing with a insole of a shoe, wherein said orthotic device is configured to be positioned inside of said raised heel shoe just anterior to said heel such that an anterior portion of said heel rests in said proximal contoured slope; and
b. a fitting adhesive operable to temporarily attach the body to the insole of shoe to test at least one location on the insole of the shoe for fit with said foot, said fitting adhesive being attached to a peel-away backing allowing the fitting adhesive to be removed from the body; and
c. a setting adhesive for attaching said orthotic device semi-permanently to said insole.

11. The device of claim 10, further comprising a distal contoured slope operable to be positioned below a portion of an arch of said foot.

12. The device of claim 10, wherein said inferior surface, said inferior surface being coated with said setting adhesive.

13. The device of claim 12, wherein said peel-away backing is operable to protect and preserve said setting adhesive until said peel-away is removed.

14. The device of claim 13, wherein said peel-away backing comprises a low-adherence upper surface in contact with said setting adhesive and a tab, such that said peel-away backing may be easily peeled from said inferior surface of said device.

15. The device of claim 13, wherein said peel-away backing comprises a lower surface on which said fitting adhesive is coated.

16. The device of claim 15, further comprising a second peel-away backing for protecting and preserving said fitting adhesive.

17. The device of claim 15, wherein said second peel-away backing comprises a low-adherence superior surface and a tab, such that said second peel-away backing may be easily peeled from said inferior surface of said first peel-away backing.

18. The device of claim 15, wherein said fitting adhesive is operable to provide a temporary, releasable adherence between said device and said insole of said shoe.

19. The device of claim 12, further comprising an inferior surface concavity and an adhesive solvent channel, said adhesive solvent channel providing a passage from a superior surface of said device to said inferior surface concavity.

20. An orthotic device for insertion into a shoe for a human foot, comprising:

a. a rigid or semi-rigid body for attachment to an insole of a shoe to prevent migration of the foot when said shoe is worn thereon;
b. a fitting adhesive operable to temporarily attach the body to the insole of shoe to test at least one location on the insole of the shoe for fit with said foot, said fitting adhesive being attached to a peel-away backing allowing the fitting adhesive to be removed from the body; and
c. a setting adhesive for attaching said orthotic device to said insole in a permanent manner.

21. The device of claim 2, wherein said peel-away backing also protects and preserves said setting adhesive.

22. The device of claim 3, wherein peel-away backing is in contact with said setting adhesive on a first side thereof and a second side thereof is coated with said fitting adhesive.

23. The device of claim 5, further comprising a second peel-away backing for protecting and preserving said fitting adhesive.

24. The device of claim 20, further comprising an inferior surface concavity and an adhesive solvent channel, said adhesive solvent channel providing a passage from a superior surface of said device to said inferior surface concavity.

* * * * *